US006357181B1

(12) United States Patent
Triemstra

(10) Patent No.: US 6,357,181 B1
(45) Date of Patent: Mar. 19, 2002

(54) DOOR HANGING ALIGNMENT PLUG

(76) Inventor: Dennis J. Triemstra, Box 206, 537 S. Main St., Markeson, WI (US) 53946

( * ) Notice: Subject to any disclaimer, the term of this patent is extended or adjusted under 35 U.S.C. 154(b) by 0 days.

(21) Appl. No.: 09/510,215

(22) Filed: Feb. 22, 2000

(51) Int. Cl.[7] ..... E06B 1/00
(52) U.S. Cl. ..... 49/380; 206/325
(58) Field of Search ..... 49/380; 206/325

(56) References Cited

U.S. PATENT DOCUMENTS 3,250,039 A * 5/1966 Strutin ..... 49/380
4,483,101 A * 11/1984 Berzina ..... 49/380
5,209,017 A * 5/1993 Ridge ..... 49/380
5,365,697 A * 11/1994 Vanderpan ..... 49/380
5,562,315 A * 10/1996 Sales ..... 292/150
5,718,082 A * 2/1998 Mori ..... 49/380
5,722,203 A * 3/1998 Staples et al. ..... 49/380
5,740,631 A * 4/1998 Mori ..... 49/380
5,787,639 A * 8/1998 Lamore ..... 49/380
6,170,198 B1 * 1/2001 Staples et al. ..... 49/380

* cited by examiner

*Primary Examiner*—Gregory J. Strimbu
(74) *Attorney, Agent, or Firm*—R. Jonathan Peters

(57) ABSTRACT

A door hanging retaining alignment plug for a pre-hung door assembly. The pre-hung door assembly including a door having a first bore opening along its free swinging edge for accommodating a retractable bolt or lock and a second bore opening along a face of the door for accommodating a lock box and communicating with the first bore. The retaining alignment plug comprises an elongated strap formed of a flexible material and a cylindrical member projecting longitudinally from one end of the strap and adaptable for seating in the first bore. The strap being adaptable for extending outwardly of the second bore, across the face of the door and the marginal edge of the jamb and across a portion of the jamb face for securing the strap to the jamb face. The strap is secured to the jamb by a suitable nail or staple.

4 Claims, 2 Drawing Sheets

DOOR HANGING ALIGNMENT PLUG

FIELD OF THE INVENTION

This invention relates to a retaining or alignment plug for a door. In its more specific aspect, this invention relates to a door hanging alignment plug for pre-hung doors or door-frame units.

BACKGROUND AND PRIOR ART

Prefabricated and pre-hung door and door frame units are in common use for new and remodeled building construction. If the door is not pre-hung, that is, if the door is not pre-hung in a suitable door frame or jamb, considerable skill and time is required to hang a door from its hinges at the building site so that the door is in proper alignment. Doors pre-hung in the frame or jamb at the factory eliminate the time and labor required at the building site to accurately hang a door from its hinges within its frame It is essential, therefore, during shipping of pre-hung doors that the pre-assembled door and frame retain its alignment or trueness.

In order to overcome any misalignment of the door during shipping, and until the door is installed at the building site, various temporary securing means or retaining means have been disclosed in the art and are in use. For example, U. S. Pat. No. 4,483,101 discloses a plastic retaining strap consisting of an elongated strap having a cup projecting at a right angle at one end of the strap. The cup projection is inserted into the transverse lock body bore opening to the face of the door, and then into the bolt bore opening to the free-swinging edge of the door, and the strap is then wrapped around the marginal edge of the door and door frame and secured thereto. However, the right-angled projection of the cup from the strap, and the transverse bending required upon placement of the strap, are disadvantageous affecting both the integrity of the strap and the accuracy of the alignment. Further, if the lock body bore has a diameter less than about two inches, the strap with the protecting cup cannot be fitted in place.

This invention has therefore has its purpose to overcome the disadvantages of the prior art, and to provide for pre-hung doors a simple door-hanging alignment plug so that the door will retain the necessary alignment until the door with its frame is hung at the building site.

SUMMARY OF THE INVENTION

In accordance with the invention, there is provided in a pre-hung door assembly having a door frame or doorjamb having substantially parallel opposed faces and opposed marginal sides or edges bridging the two faces. A door is hingedly mounted at one edge to the door frame, and the opposed free-swinging edge of the door is opposing one face of the jamb. The door has a first bore opening along the free-swinging edge for accommodating a retractable bolt, latch, or lock, and a second bore opening outwardly at the face of the door for accommodating a lock box and communicating with the first bore. There is provided a retaining alignment plug comprising: (a) an elongated strap formed of a flexible material and a cylindrical member projecting longitudinally from one end of the strap and adaptable for seating in the first bore; and (b) the free end of the strap being adaptable for insertion into the first bore and the second bore to bring the cylindrical member into seating engagement in the first bore so that the strap extends outwardly of the second bore and across the face of the door to its free-swinging edge, over the marginal edge of the jamb, and across a portion of the jamb face for securing the strap member to the jamb face. The strap is secured to the jamb by a suitable means such as a nail or staple.

BRIEF DESCRIPTION OF THE ACCOMPANYING DRAWINGS

The invention and its advantages will be more readily understood by reference to the following detailed description and exemplary embodiments when read in conjunction with the following drawings, wherein.

DETAILED DESCRIPTION OF THE INVENTION AND PREFERRED EMBODIMENT

Figure 1:
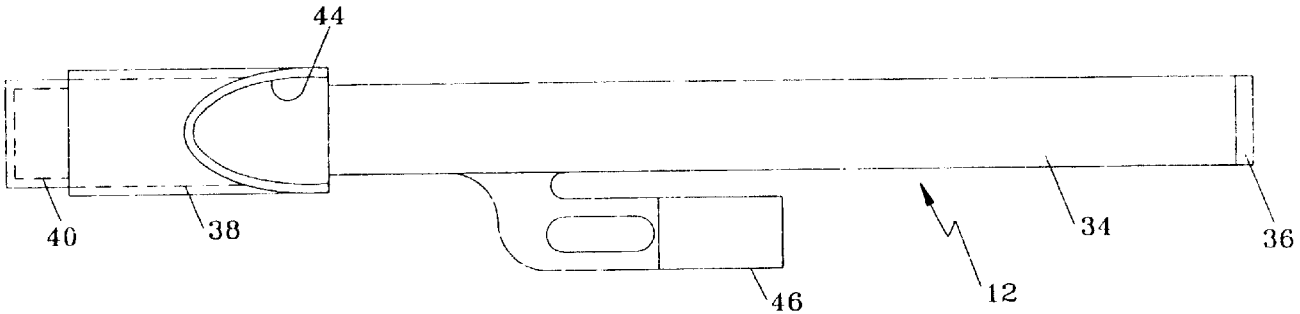
FIG. 1 is a plan view of the retaining alignment plug embodying my invention showing the elongated strap and longitudinally projecting cylinder.
Figure 3:
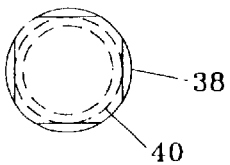
FIG. 3 is an end view of the retaining alignment plug of FIG. 1.
Figure 4:
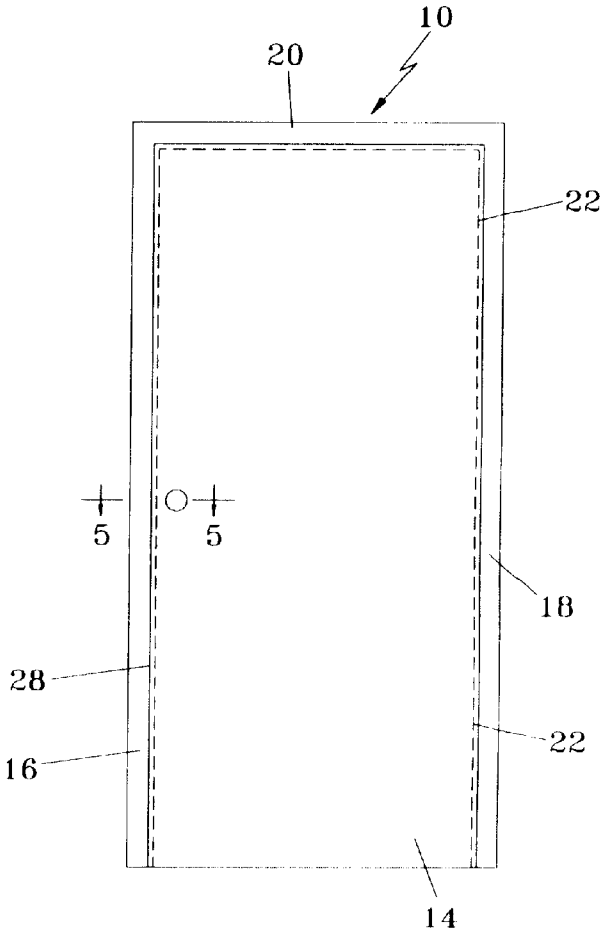
FIG. 4 is an elevational view, in plan, of a complete pre-hung door and frame assembly secured by the retaining alignment plug of this invention ready for shipment and installation at the building site.

Referring to the drawings wherein the same reference numerals refer to similar parts throughout the various views, there is shown in FIG. 4 a pre-hung door assembly, indicated generally at 10, utilizing a retaining alignment plug of my invention, indicated generally by the numeral 12, as shown in FIG. 1, and ready for shipment from the factory to a building site. The door assembly 10 comprises a door 14 mounted in a frame having opposed jamb members 16 and 18 and a header 20. The door 14 is hingedly supported at 22 along one side to jamb member 18 so that the door is free to swing on the jamb 18. A door stop 24 is attached to the iamb member 16 by any suitable means, e.g., nails or screws. Clearance spacer 26 may be provided as needed between the top and opposed sides of the door 14 and the corresponding sides of the frame 16 and 18 to better assure proper alignment of the assembly. The door 14 also includes a free swinging edge 28 opposed to the hinged edge 22 thereof.

The door 14 is provided with a first bore 30 transverse to the free swinging edge 28 and opens to the free swinging edge. In the art or trade, this first bore is sometimes referred to as the latch bore or edge bore. This first bore or transverse bore 30 provides a lock opening and is adaptable for accommodating a suitable lock bolt (not shown). The face of the door 14 is provided with a second bore 32, adjacent the first bore 30, and the second bore 32 opens to the opposed faces of the door. The second bore, in the art or trade, is referred to as the body bore or cross bore, and can be about 2 and ⅛ inch in diameter, but frequently is substantially smaller. The second bore 32 is adaptable for accommodating a lock body. It will be observed that the longitudinal axis of the second bore 32 is substantially transverse to the face of the door, and substantially transverse to the longitudinal axis of the first bore 30. Further, it will be observed that the second bore 32 is in communication with or opens to the first bore 30. In this manner, at the building site a lock body can be inserted into the bore 32 from which extends a retractable lock bolt.

Figure 2:
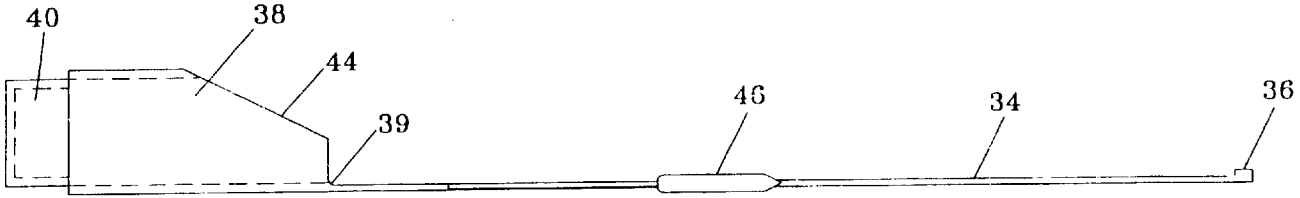
FIG. 2 is a side elevational view of the retaining alignment plug of FIG. 1.

Referring in particular to FIG. 1 and to FIG. 2, there is shown in detail the door alignment plug 12, formed of a flexible plastic, or other suitable flexible material, such as polyethylene or polypropylene. Retaining alignment plug 12 must be sufficiently thick and exhibit sufficient integrity to withstand some stress caused by the door swinging and by shipping and handling. I have found that the strap can be about 1/16 inch thick, plus or minus 1/64 of an inch, and can be fabricated by injection molding using recycled plastic.

The alignment plug 12 comprises elongated strap 34, which desirably may be from about six to eight inches in length, and terminates at one end or the free end with one or more transverse ribs or projections 36 to facilitate gripping of the strap by the worker. At the opposite end of the strap 34 is cylindrical member or cup 38 projecting longitudinally from the strap. It will be observed that the longitudinal axis of the strap 34 is substantially parallel with the longitudinal axis of cylindrical member 38. Because the juncture between the plug and the strap is subject to bending, it is desirous to provide this juncture with a radius 30 to enhance the integrity of the structure. Where desired, the cylindrical member can have a truncated conical configuration as viewed in profile, and preferably is hollow to facilitate handling and inserting the plug in place, as described below in detail, and also to reduce the quantity of material needed to fabricate the plug and substantially reduce the weight of the plug.

Cylindrical member 38, having a substantially circular transverse cross-section, preferably has a substantially rectangular extension or projection 40. The diagonals of the rectangular projection 40 are about equal to the diameter of the cylinder 38, so that the four corners of the projection are about flush with the wall of the cylinder. It will be observed that the jamb 16 has a rectangular opening 42 for accommodating the bolt (not shown) when turned to a locked or extended position. Thus, the rectangular projection 40 is designed to fit the rectangular opening 42. In this manner, the door is more secure for handling and shipping. In addition, the cylindrical member 38 is provided with a diagonal cut-out at 44, less than the fill diameter of the cylinder, which makes it easier for the worker to insert the retaining plug in position.

Where desired, the strap 34 is provided with a flat spacer 46 extending transversely from the marginal edge of the strap and in the same plane as the strap, that is co-planar with the strap. In the construction and installation of a door, there is a space between the free swinging edge of the door and the jamb in order to make an allowance for the arc of the door as it opens and closes. This space most typically is about 3/32 of an inch. The spacer 46 is of about the same thickness, and upon installation of the door hanging alignment plug, the spacer is inserted into this space between the door and the jamb, thereby better aligning and securing the door for shipping and handling.

Figure 5:
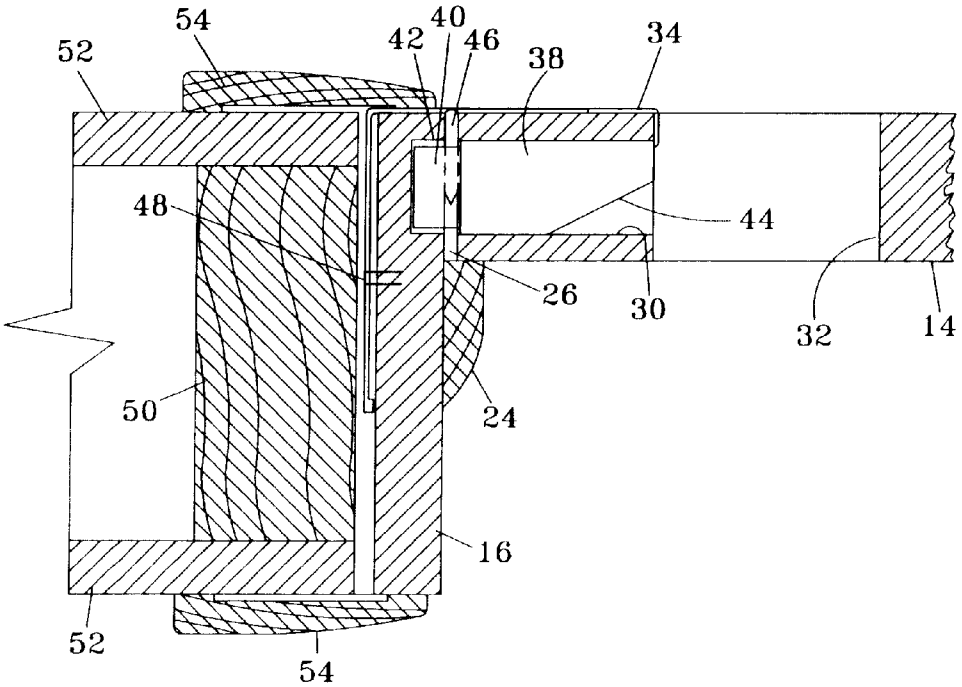
FIG. 5 is a horizontal sectional view taken on line 5—5 of FIG. 4 showing in greater detail the placement of the retaining alignment plug.

In the manufacture of the door assembly comprising the door and door frame or jamb, there is no need to align and secure the door with nails and screws, which later would have to be removed thereby leaving holes and possibly even splitting the wood. In accordance with my invention, the door retaining alignment plug 12, which is used to align and secure the door in a closed position, is positioned by seating the cylindrical body 38 in the first bore 30. In accomplishing this step, the door is in an open position so that the first bore 30 is open to the free swinging edge of the door, the free end of the strap 34 is threaded or inserted into the first bore and then into the second bore 32. The free end of the strap then can be gripped by the worker and pulled into position so that the cylindrical body 38 seats in the first bore. It will be obseved, that because this first bore 30 opens to the second bore 32, the strap 300 and cylindrical body 38 can be manipulated by the worker so that the cylinder including the rectangular projection 40 is completely and correctly seated into the bore 30 so as to be clear of or not extend beyond the free swinging edge of the door. The door is then closed, and the plug is manipulated so that the rectangular projection 40 is seated in rectangular opening 42 of jamb 16. The strap 34 is then extended outwardly from the second bore 32 and across the face of the door 14 to its free-swinging edge and the marginal edge of the jamb 16 and across a portion of the jamb face. (See FIG. 5.) If the plug is provided with spacer 46, this spacer is inserted between the free-swinging edge of the door and the opposing face of the jamb. The strap is then secured to the jamb, as with staple 48. The pre-hung door assembly can now be shipped. At the building site, the door assembly is hung in place, as with hinges, the jamb 16 is positioned adjacent stud 50, which is between dry wall sections 52, and the appropriate trim 54. The alignment plug is removed, and the door is now in a working position.

It will be observed that by reason of my invention, the door hanging alignment plug provides several advantages, including a facile and simplified means for maintaining a door aligned and secured. Most significantly, a door with a body bore of a small diameter such as two inches or less, e.g. one inch, presents no problem in seating the door plug, because the longitudinal axis of the strap is aligned with or parallel with the longitudinal axis of the cylindrical member. Further, it should be understood that the foregoing detailed description has been given for clearness of understanding only, and no unnecessary limitations should be understood therefrom, as modifications will be obvious to those skilled in the art.

What is claimed is:

1. In a pre-hung door assembly including a door and a door frame having opposed first and second side members and a header, said door hingedly mounted at one edge thereof to the first side member of the door frame and a free-swinging edge of said door opposing the second side member, the door having a first bore opening along the free-swinging edge and a second bore opening along a face of the door and communicating with the first bore, said second side member having a transverse blind bore opposite said first bore; a retaining alignment plug comprising an elongated strap formed of a flexible material, and a cylindrical member projecting longitudinally from one end of said strap, having a longitudinal axis parallel with the longitudinal axis of the strap when said plug is not in use and adaptable for seating in said first bore, said cylindrical member having an extension adaptable for seating in said transverse blind bore and said strap adaptable for extending outwardly of said second bore, across a marginal edge of said second side member and across a portion of a face of said second side member for securing said plug to the said second side a member.

2. In a pre-hung door assembly of claim 1 wherein a juncture between said elongated strap and said cylindrical member is radiased.

3. In a pre-hung door assembly of claim 1 wherein said extension of said cylindrical member is substantially rectangular and adaptable for seating in said transverse blind bore.

4. In a pre-hung door assembly of claim 1 wherein said strap includes a spacer extending transversely from an edge of said strap.

* * * * *